US007430859B2

(12) United States Patent
Jang et al.

(10) Patent No.: US 7,430,859 B2
(45) Date of Patent: Oct. 7, 2008

(54) FLUID PUMP CONTROL SYSTEM FOR EXCAVATORS

(75) Inventors: Dal Sik Jang, Seoul (KR); Ki Nam Jung, Chungchoongnam-do (KR)

(73) Assignee: Doosan Infracore Co., ltd., Ichon (KR)

( * ) Notice: Subject to any disclaimer, the term of this patent is extended or adjusted under 35 U.S.C. 154(b) by 303 days.

(21) Appl. No.: 11/323,508

(22) Filed: Dec. 29, 2005

(65) Prior Publication Data

US 2006/0147315 A1 Jul. 6, 2006

(30) Foreign Application Priority Data

Dec. 30, 2004 (KR) ..... 10-2004-0116404

(51) Int. Cl.
*F04B 49/00* (2006.01)
*F15B 11/16* (2006.01)
*F16H 61/40* (2006.01)

(52) U.S. Cl. ..... 60/445; 60/452

(58) Field of Classification Search ..... 60/422, 60/445, 452, 484
See application file for complete search history.

(56) References Cited

U.S. PATENT DOCUMENTS 4,067,193 A * 1/1978 Norick ..... 60/445
4,129,987 A * 12/1978 Blume ..... 60/452
5,267,440 A * 12/1993 Nakamura et al. ..... 60/452
5,398,507 A * 3/1995 Akiyama et al. ..... 60/452
6,119,967 A * 9/2000 Nakayama et al. ..... 60/452
6,209,322 B1 * 4/2001 Yoshida et al. ..... 60/452
6,311,489 B1 * 11/2001 Stangl et al. ..... 60/452
6,662,558 B1 * 12/2003 Nelson ..... 60/452
7,069,674 B2 * 7/2006 Arii ..... 60/422
7,284,371 B2 * 10/2007 Toji et al. ..... 60/445
7,290,390 B2 * 11/2007 Kim ..... 60/445

* cited by examiner

*Primary Examiner*—Thomas E Lazo
(74) *Attorney, Agent, or Firm*—Lee, Hong, Degerman, Kang & Schmadeka

(57) ABSTRACT

A fluid pump control system for excavators enables fluid pumps to produce hydraulic flows of a quantity great enough to actuate hydraulic actuators for smooth composite operations. The system includes variable displacement fluid pumps, fluid quantity control mechanisms for controlling the discharge quantity of the respective fluid pumps, fluid quantity control signal lines respectively connected to the fluid quantity control mechanisms, signal pressure control lines for bringing the fluid quantity control signal lines into connection with a fluid tank to drop the fluid quantity control signal pressures within the fluid quantity control signal lines, and a plurality of cutoff valves attached to the signal pressure control lines in tandem and shiftable in concert with the shifting movement of spools of a control valve for increasing the fluid quantity control signal pressures within the signal pressure control lines in proportion to the shifting amounts of the cutoff valves.

3 Claims, 5 Drawing Sheets

(Pi = P2)

(Pi = P1 + P2)

FLUID PUMP CONTROL SYSTEM FOR EXCAVATORS

This application claims the benefit of the Korean Patent Application No. 10-2004-0116404, filed on Dec. 30, 2004, which is hereby incorporated by reference as if fully set forth herein.

BACKGROUND OF THE INVENTION

1. Field of the Invention

The present invention pertains to a fluid pump control system for excavators and, more specifically, to a fluid pump control system adapted for controlling a discharge quantity of a variable displacement fluid pump in proportion to a manipulation amount of a remote control valve.

2. Description of the Related Art

Known systems for controlling a fluid pump in excavators include a positive pump control system that controls the discharge quantity of a pump in proportion to the magnitude of an input signal and a negative pump control system that controls the pump discharge quantity in inverse proportion to the magnitude of the input signal.

One example of the positive control system is shown in FIG. 1. As shown, the positive control system comprises variable displacement fluid pumps 101, 102 for producing hydraulic flows into main fluid pressure lines 110, 111 along which a plurality of spools 103A, 103B, 104A, 104B of control valves 103, 104 are disposed one after another. The spools 103A, 103B, 104A, 104B are also in fluid communication with the fluid pumps 101, 102 through parallel lines.

Remote control valves 105, 106 are provided to reduce the pressure of a hydraulic flow generated by a pilot pump (not shown) to thereby create pilot signal pressures which in turn are transmitted through pilot signal lines 105A-D, 106A-D to pressure receiving parts on opposite sides of the spools 103A, 103B, 104A, 104B of the control valves 103, 104. Responsive to the pilot signal pressures, the spools 103A, 103B, 104A, 104B are shifted in one direction to allow the hydraulic flows of the fluid pumps 101, 102 to be supplied to a variety of actuators not shown in the drawings.

Operatively connected to swash plates of the variable displacement fluid pumps 101, 102 are discharge quantity regulators 101A, 101B that remain in fluid communication with shuttle valves 107A, 107B, 108A, 108B for selecting the greatest one of the pilot signal pressures outputted from the remote control valves 105, 106 to supply a quantity control signal pressure Pi to the regulators 101A, 101B. In proportion to the magnitude of the quantity control signal pressure Pi, the regulators 101A, 101B serve to variably control the discharge quantity of the fluid pumps 101, 102.

Referring to FIG. 2, which graphically illustrates the correlation of the quantity control signal pressure Pi and the discharge quantity Q of the fluid pumps 101, 102, it can be seen that the discharge quantity Q of the fluid pumps 101, 102 is increased from Q1 to Q2 as the remote control valves 105, 106 generate the pilot signal pressures of greater magnitude and hence the quantity control signal pressure Pi supplied by the shuttle valves 107A, 107B, 108A, 108B grows from P1 to P1. Inversely, reduction of the quantity control signal pressure Pi results in proportional decrease of the discharge quantity Q of the fluid pumps 101, 102.

In the positive pump control system as noted above, if the remote control valves 105, 106 are manipulated simultaneously and generate a couple of pilot signal pressures P1, P2 for the purpose of causing the excavator to perform composite operations through the simultaneous actuation of at least two hydraulic actuators, the shuttle valves 107A, 107B, 108A, 108B adopt the greater one P2 of the pilot signal pressures P1, P2 as the quantity control signal pressure Pi but discard the smaller one P1.

As a result, the fluid pumps 101, 102 produce the hydraulic flows of the discharge quantity Q2 corresponds to the adopted pilot signal pressure P2, which means that the quantity of the hydraulic flows is not sufficient to actuate two or more actuators at one time and carry out the composite operations smoothly.

In contrast, the negative pump control system can acquire a quantity control signal pressure that covers the entire pilot pressures applied to the respective spools of the control valve, thus removing the drawbacks inherent in the positive pump control system. In the negative pump control system, however, an orifice and a relief valve are attached to the downstream-most side of a bypass line in order to detect the quantity control signal pressure. The orifice and the relief valve tend to create a pressure loss which makes it difficult to accurately detect the quantity control signal pressure. This results in the fluid pumps discharging an inaccurately controlled quantity of hydraulic flows, which may cause a difficulty in performing the composite operations in a precise manner.

SUMMARY OF THE INVENTION

Taking into account the afore-mentioned and other problems inherent in the prior art fluid pump control systems, it is an object of the present invention to provide a fluid pump control system for excavators that can acquire a positive fluid quantity control signal corresponding to the total sum of pilot signal pressures generated by remote control valves and, in proportion to magnitude of the positive fluid quantity control signal thus acquired, enables fluid pumps to produce hydraulic flows of a quantity great enough to actuate hydraulic actuators for smooth composite operations.

With this object in mind, one aspect of the present invention is directed to a fluid pump control system for excavators, comprising: at least one variable displacement fluid pump and a pilot pump each for producing a hydraulic flow; fluid quantity control mechanisms for controlling the discharge quantity of the respective fluid pumps; a control valve having a plurality of spools for controlling the hydraulic flow produced by the fluid pump and supplied to a plurality of hydraulic actuators through main fluid lines; remote control valves for reducing the pressure of the hydraulic flow produced by the pilot pump in proportion to manipulation amounts of control levers and for applying pilot signal pressures to the control valve through pilot signal lines to thereby shift the spools in one direction; fluid quantity control signal lines respectively bifurcated from the main fluid lines and connected to the fluid quantity control mechanisms in such a manner that the hydraulic flows in the main fluid lines can apply fluid quantity control signal pressures to the fluid quantity control mechanisms; signal pressure control lines for bringing the fluid quantity control signal lines into connection with a fluid tank to drop the fluid quantity control signal pressures within the fluid quantity control signal lines; and a plurality of cutoff valves attached to the signal pressure control lines in tandem and shiftable in concert with the shifting movement of the spools of the control valve for increasing the fluid quantity control signal pressures within the signal pressure control lines in proportion to the shifting amounts of the cutoff valves.

In a fluid pump control system of the present invention, it is preferred that each of the cutoff valves should be adapted to increase the fluid quantity control signal pressures by reducing the flow path section areas of the signal pressure control lines in proportion to the magnitude of the pilot signal pressures of the remote control valves.

In a fluid pump control system of the present invention, it is preferred that the system should further comprise pressure-reducing valves and orifices attached to the fluid quantity control signal lines.

Another aspect of the present invention is directed to a fluid pump control system for excavators, comprising: at least one variable displacement fluid pump and a pilot pump each for producing a hydraulic flow; fluid quantity control mechanisms for controlling the discharge quantity of the respective fluid pumps; a control valve having a plurality of spools for controlling the hydraulic flow produced by the fluid pump and supplied to a plurality of hydraulic actuators through main fluid lines; remote control valves for reducing the pressure of the hydraulic flow produced by the pilot pump in proportion to manipulation amounts of control levers and for applying pilot signal pressures to the control valve through pilot signal lines to thereby shift the spools in one direction; at least one auxiliary pump for creating and applying fluid quantity control signal pressures to the fluid quantity control mechanisms; fluid quantity control signal lines for connecting the auxiliary pump to the fluid quantity control mechanisms so that the fluid quantity control signal pressures created by the auxiliary pump can be applied to the fluid quantity control mechanisms; signal pressure control lines for bringing the fluid quantity control signal lines into connection with a fluid tank to drop the fluid quantity control signal pressures; and a plurality of cutoff valves attached to the signal pressure control lines in tandem and shiftable by the pilot signal pressure applied to the spools of the control valve for reducing the flow path section areas of the signal pressure control lines to increase the fluid quantity control signal pressures within the fluid quantity control signal lines in proportion to the shifting amounts of the cutoff valves.

In a fluid pump control system of the present invention, it is preferred that the system should further comprise relief valves attached to the fluid quantity control signal lines.

According to the present invention as summarized above, the fluid quantity control signal pressures for controlling the discharge quantity of fluid pumps are determined and varied by the total sum of pilot signal pressures, thus enabling the fluid pumps to produce hydraulic flows of a quantity great enough to actuate hydraulic actuators for smooth composite operations. This helps to improve the excavator's performance of conducting the composite operations.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Now, preferred embodiments of a fluid pump control system for excavators in accordance with the present invention will be described in detail with reference to the accompanying drawings.

Figure 1:
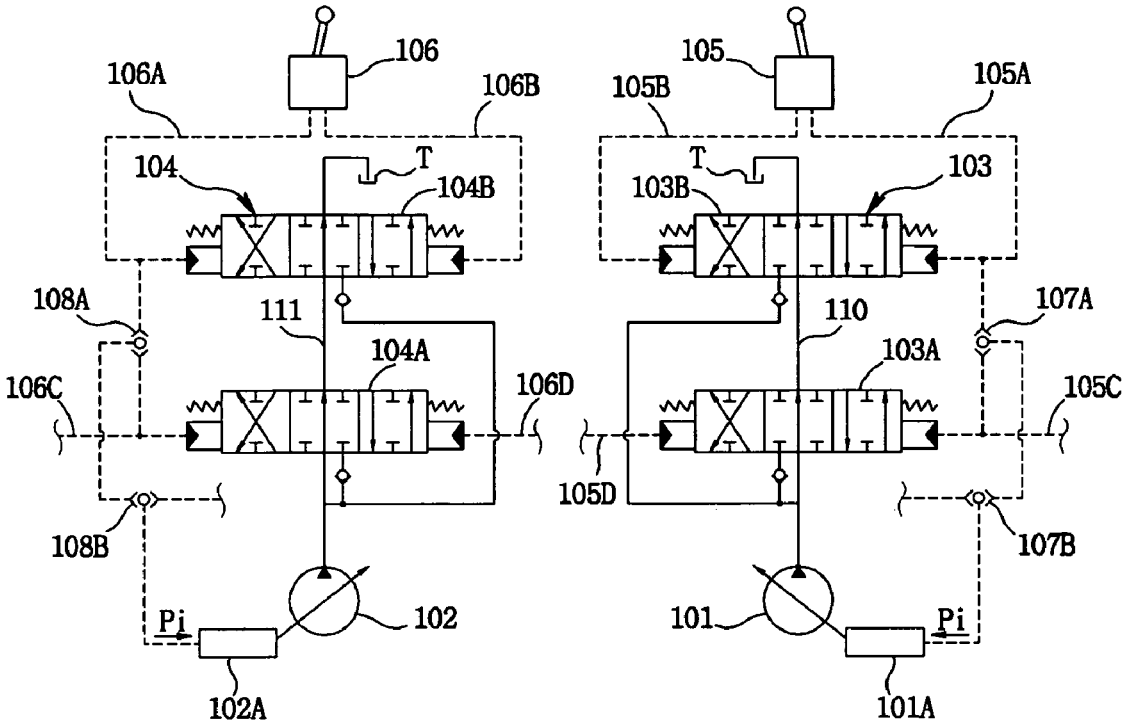
FIG. 1 (PRIOR ART)
FIG. 1 is a schematic fluid pressure circuit diagram showing a prior art fluid pump control system for excavators.
Figure 2:
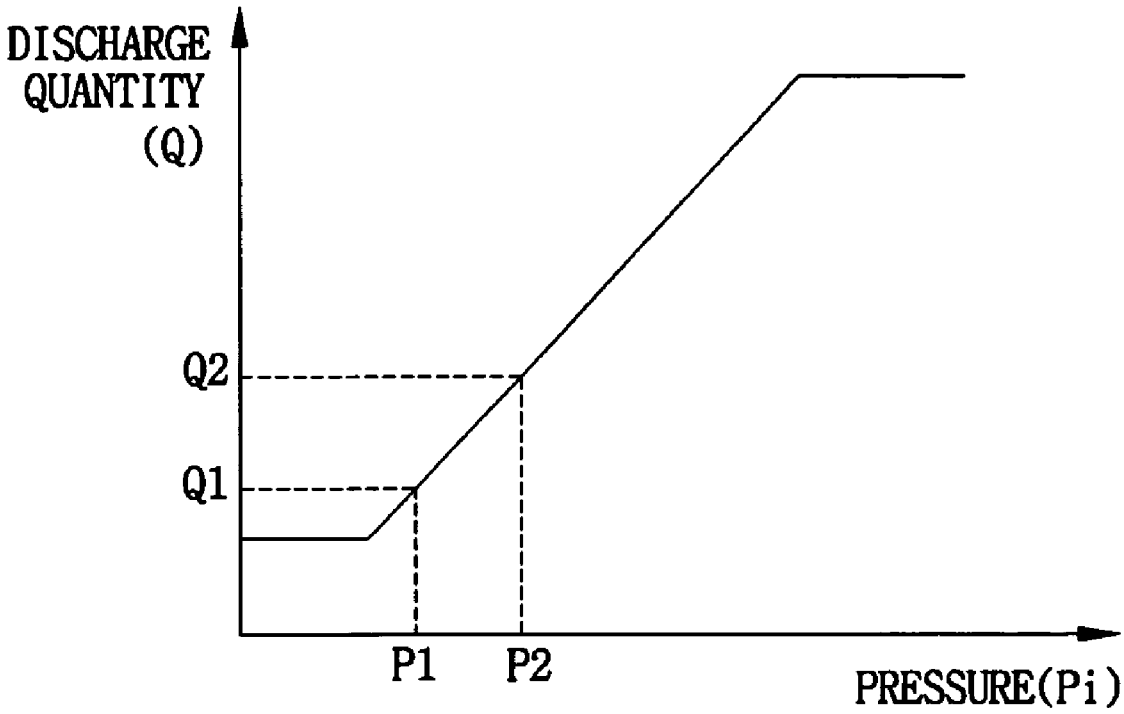
FIG. 2 (PRIOR ART)
FIG. 2 is a graphical representation illustrating the correlation between a quantity control signal pressure and a discharge quantity of fluid pumps in the prior art system shown in FIG. 1.
Figure 3:
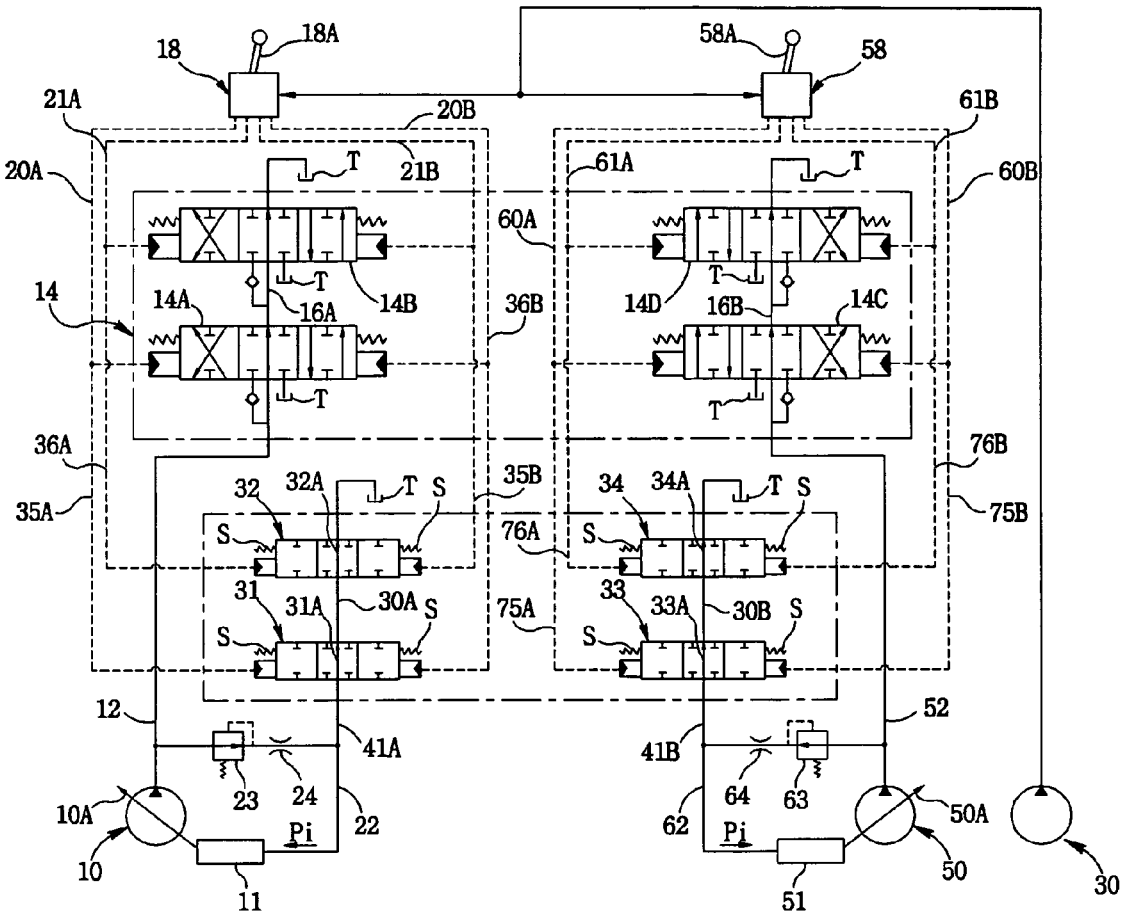
FIG. 3 is a schematic fluid pressure circuit diagram showing a fluid pump control system for excavators according to one embodiment of the present invention.

Referring first to FIG. 3, which shows a fluid pump control system for excavators according to one embodiment of the present invention, the fluid pump control system includes a couple of variable displacement fluid pumps 10, 50 whose discharge capacities are varied by the inclination angle of swash plates 10A, 50A operatively connected to fluid quantity control mechanisms 11, 51, and a pilot pump 30 whose discharge capacity remain constant.

A control valve 14 is connected to the fluid pumps 10, 50 through main fluid pressure lines 12, 52 and has a plurality of spools 14A-D for controlling the hydraulic flows produced by the fluid pump 10, 50 and supplied to a plurality of hydraulic actuators (not shown) through the main fluid lines 12, 52.

The hydraulic flows in the main fluid pressure lines 12, 52 are drained to a fluid tank T through center bypass lines 16A, 16B along which the spools 14A-D of the control valve 14 are sequentially disposed from upstream to downstream.

The spools 14A-D of the control valve 14 are provided at their opposite sides with pressure receiving parts that remain in fluid communication with remote control valves 18, 58 through pilot signal lines 20A, 20B, 21A, 21B, 60A, 60B, 61A, 61B. The remote control valves 18, 58 are adapted to reduce the pressure of the hydraulic flow produced by the pilot pump 30 in proportion to manipulation amounts of control levers 18A, 58A and then create and apply pilot signal pressures to the pressure receiving parts of the spools 14A-D of the control valve 14 through the pilot signal lines 20A, 20B, 21A, 21B, 60A, 60B, 61A, 61B to thereby shift the spools 14A-D in one direction.

The fluid quantity control mechanisms 11, 51 of the respective fluid pumps 10, 50 are connected to the main fluid pressure lines 12, 52 through fluid quantity control signal lines 22, 62 to receive the fluid pressures built up in the main fluid pressure lines 12, 52 as fluid quantity control signal pressures for the fluid pumps 10, 50. Pressure-reducing valves 23, 63 and orifices 24, 64 are attached to the fluid quantity control signal lines 22, 62. The pressure-receiving valves 23, 63 serve to delimit the fluid quantity control signal pressures acting on the fluid quantity control mechanisms 11, 51 to below a predetermined pressure value, whereas the orifices 24, 64 function to reduce the hydraulic flow fed to the fluid quantity control mechanisms 11, 51.

Signal pressure control lines 41A, 41B are bifurcated from the fluid quantity control signal lines 22, 62 downstream the orifices 24, 64 for bringing the fluid quantity control signal lines 22, 62 into connection with the fluid tank T.

A plurality of cutoff valves 31-34 corresponding to the spools 14A-D of the control valve 14 are sequentially attached to the signal pressure control lines 41A, 41B in tandem. The cutoff valves 31-34 are shiftable into operative positions in concert with the shifting movement of the spools 14A-D of the control valve 14 for increasing the fluid quantity control signal pressures within the signal pressure control lines 41A, 41B in proportion to the shifting amounts of the cutoff valves 31-34. The cutoff valves 31-34 are normally kept in neutral positions where the hydraulic flow in the signal pressure control lines 41A, 41B is drained to the fluid tank T through bypass flow paths 31A-34A and can be shifted to the left or right into the operative positions where the signal pressure control lines 41A, 41B are disconnected from the fluid tank T to build up the fluid quantity control signal pressures within the signal pressure control lines 41A, 41B.

The cutoff valves 31-34 are provided with pressure receiving parts and springs S at their opposite sides. The pressure receiving parts of the cutoff valves 31-34 are in fluid communication with the remote control valves 18, 58 through the control lines 35A, 35B, 36A, 36B, 75A, 75B, 76A, 76B and the pilot signal lines 20A, 20B, 21A, 21B, 60A, 60B, 61A, 61B so that the cutoff valves 31-34 and the spools 14A-D of the control valve 14 can be shifted in concert in proportion to the magnitude of the pilot signal pressures created by the remote control valves 18, 58. The springs S return the cutoff valves 31-34 back to the neutral positions if no pilot signal pressure is exerted on the pressure receiving parts of the cutoff valves 31-34.

Description will now be offered regarding the operations of the fluid pump control system for excavators of the present invention.

[1] In Case of Actuating No Hydraulic Actuator

The spools 14A-D of the control valve 14 receive no pilot signal pressure from the remote control valves 18, 58 and therefore are all kept in the neutral positions where the hydraulic flows produced by the fluid pumps 10, 50 are drained to the fluid tank T through the bypass lines 16A, 16B, thus building up no pressure in the main fluid pressure lines 12, 52. Accordingly, no quantity control signal pressure Pi is developed in the fluid quantity control signal lines 22, 62 that communicate with the main fluid pressure lines 12, 52. This permits the fluid quantity control mechanisms 11, 51 to minimize the inclination angle of the swash plates 10A, 50A so that the fluid pumps 10, 50 can discharge a minimized quantity of hydraulic flows.

[2] In Case of Actuating a Single Hydraulic Actuator

If one of the control levers 18A, 58A of the remote control valves 18, 58 is manipulated to actuate a single hydraulic actuator, the corresponding one of the remote control valves 18, 58 creates a pilot signal pressure in proportion to the manipulation amount of the control lever 18A or 58A. The pilot signal pressure thus created is applied to the pressure receiving parts of the corresponding spools 14A-D of the control valve 14 through the pilot signal lines 20A, 20B, 21A, 21B, 60A, 60B, 61A, 61B and also to the pressure receiving parts of the cutoff valves 31-34 through the control lines 35A, 35B, 36A, 36B, 75A, 75B, 76A, 76B so that the spools 14A-D and the cutoff valves 31-34 are shifted in one direction from their neutral positions in proportion to the pilot signal pressure.

In proportion to the moving amount from the neutral positions, the cutoff valves 31-34 reduce the quantity of the hydraulic flow drained through the signal pressure control lines 41A, 41B to thereby increase the quantity control signal pressure in the fluid quantity control signal lines 22, 62, in response to which the fluid quantity control mechanisms 11, 51 increase the inclination angle of the swash plates 10A, 50A so that the fluid pumps 10, 50 can discharge an increased quantity of hydraulic flows.

For example, if one of the control levers 18A, 58A of the remote control valves 18, 58 is pulled to the maximum extent, the corresponding remote control valve 18 or 58 creates a pilot signal pressure of the greatest magnitude in proportion to the manipulation amount of the control lever 18A or 58A and applies the pilot signal pressure to the pressure receiving parts of the corresponding spools 14A-D of the control valve 14 through the pilot signal lines 20A, 20B, 21A, 21B, 60A, 60B, 61A, 61B and also to the pressure receiving parts of the cutoff valves 31-34 through the control lines 35A, 35B, 36A, 36B, 75A, 75B, 76A, 76B so that the spools 14A-D and the cutoff valves 31-34 are shifted to their maximum strokes.

As a consequence, the cutoff valves 31-34 close off the signal pressure control lines 41A, 41B completely to maximize the quantity control signal pressures in the fluid quantity control signal lines 22, 62, whereby the fluid quantity control mechanisms 11, 51 enables the fluid pumps 10, 50 to produce a maximized quantity of hydraulic flows which in turn are supplied to the corresponding actuator through the spools 14A-D of the control valve 14 to move the actuator at a greatest speed.

On the other hand, if one of the control levers 18A, 58A of the remote control valves 18, 58 is manipulated to a smaller extent in order to finely actuate one of the hydraulic actuators, the corresponding remote control valve 18 or 58 creates a pilot signal pressure of a reduced magnitude in proportion to the manipulation amount of the control lever 18A or 58A and applies the pilot signal pressure to the pressure receiving parts of the corresponding spools 14A-D of the control valve 14 through the pilot signal lines 20A, 20B, 21A, 21B, 60A, 60B, 61A, 61B and also to the pressure receiving parts of the cutoff valves 31-34 through the control lines 35A, 35B, 36A, 36B, 75A, 75B, 76A, 76B so that the spools 14A-D and the cutoff valves 31-34 are shifted with reduced displacements, thereby partially reducing the flow path section areas of the signal pressure control lines 41A, 41B.

As a result, the cutoff valves 31-34 partially close off the signal pressure control lines 41A, 41B to increase the quantity control signal pressures in the fluid quantity control signal lines 22, 62 in proportion to the reduction of the flow path section areas of the signal pressure control lines 41A, 41B. Responsive to the increase of the quantity control signal pressures, the fluid quantity control mechanisms 11, 51 enables the fluid pumps 10, 50 to produce a slightly increased quantity of hydraulic flows which in turn are supplied to the corresponding actuator through the spools 14A-D of the control valve 14 to move the actuator at a low speed.

[3] In Case of Actuating Two or More Actuators for Composite Operations

If the control levers 18A, 58A of the remote control valves 18, 58 are manipulated to simultaneously actuate two or more hydraulic actuators (two actuators in the present embodiment) for composite operations of an excavator, the remote control valves 18, 58 create two pilot signal pressures in proportion to the manipulation amounts of the control levers 18A, 58A. The pilot signal pressures thus created are applied to the pressure receiving parts of the spools 14A-D of the control valve 14 through the pilot signal lines 20A, 20B, 21A, 21B, 60A, 60B, 61A, 61B and also to the pressure receiving parts of the cutoff valves 31-34 through the control lines 35A, 35B, 36A, 36B, 75A, 75B, 76A, 76B. This ensures that the spools 14A-D and the cutoff valves 31-34 are shifted in one direction from their neutral positions in proportion to the pilot signal pressures transmitted to their pressure receiving parts.

Due to the fact that the cutoff valves 31-34 are disposed in series along the signal pressure control lines 41A, 41B, the cutoff valves 31-34 are mutually independently shifted in proportion to the magnitude of the pilot signal pressures applied thereto through the control lines 35A, 35B, 36A, 36B, 75A, 75B, 76A, 76B, thus reducing the quantity of the hydraulic flows drained through the signal pressure control lines 41A, 41B on a control line basis. Accordingly, the total sum of the quantity control signal pressures built up by the respective cutoff valves 31-34 is delivered to the fluid quantity control mechanisms 11, 51, in response to which the fluid pumps 10, 50 increase the discharge quantity of the hydraulic flows.

In other words, the cutoff valves 31, 33 ("first cutoff valves") disposed on an upstream side of each of the bypass lines 30A, 30B are shifted with a displacement in proportion to the magnitude of the pilot signal pressures and reduce the quantity of the hydraulic flows drained through the bypass lines 30A, 30B in proportion to the shifting displacement thereof. This builds up a quantity control signal pressure ("first quantity control signal pressure") in the fluid quantity control signal lines 22, 62 that corresponds to the reduction quantity of the hydraulic flows drained through the bypass lines 30A, 30B.

Concurrently, the cutoff valves 32, 34 ("second cutoff valves") disposed on an downstream side of each of the bypass lines 30A, 30B from the first cutoff valves 31, 33 are independently shifted with a displacement in proportion to the magnitude of the pilot signal pressures and reduce the quantity of the hydraulic flows drained through the bypass lines 30A, 30B in proportion to the shifting displacement thereof, thus building up a second quantity control signal pressure in the fluid quantity control signal lines 22, 62 that differs from the first quantity control signal pressure.

Figure 4:
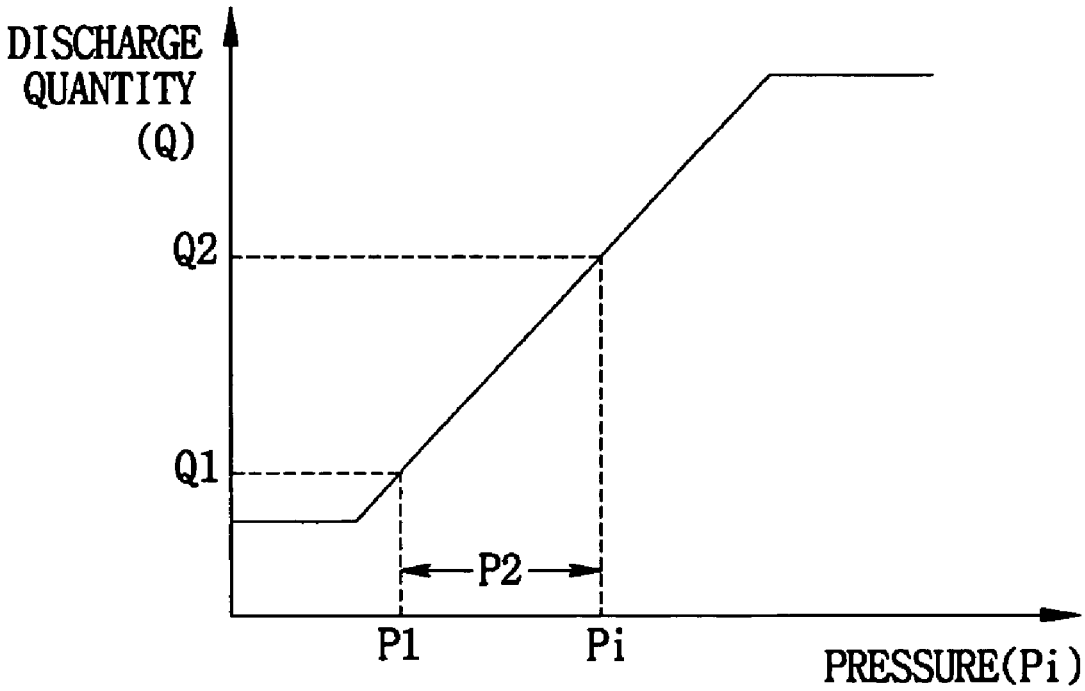
FIG. 4 is a graphical representation illustrating the correlation between a quantity control signal pressure and a discharge quantity of fluid pumps in the system of the present invention shown in FIG. 3.

Accordingly, as shown in FIG. 4, the total sum (P1+P2) of the first and second quantity control signal pressures built up by the shifting displacement of the cutoff valves 31-34 is applied to the fluid quantity control mechanisms 11, 51 as a quantity control signal pressure Pi. This enables the fluid pumps 10, 50 to produce hydraulic flows of a quantity great enough to actuate hydraulic actuators for smooth composite operations.

Figure 5:
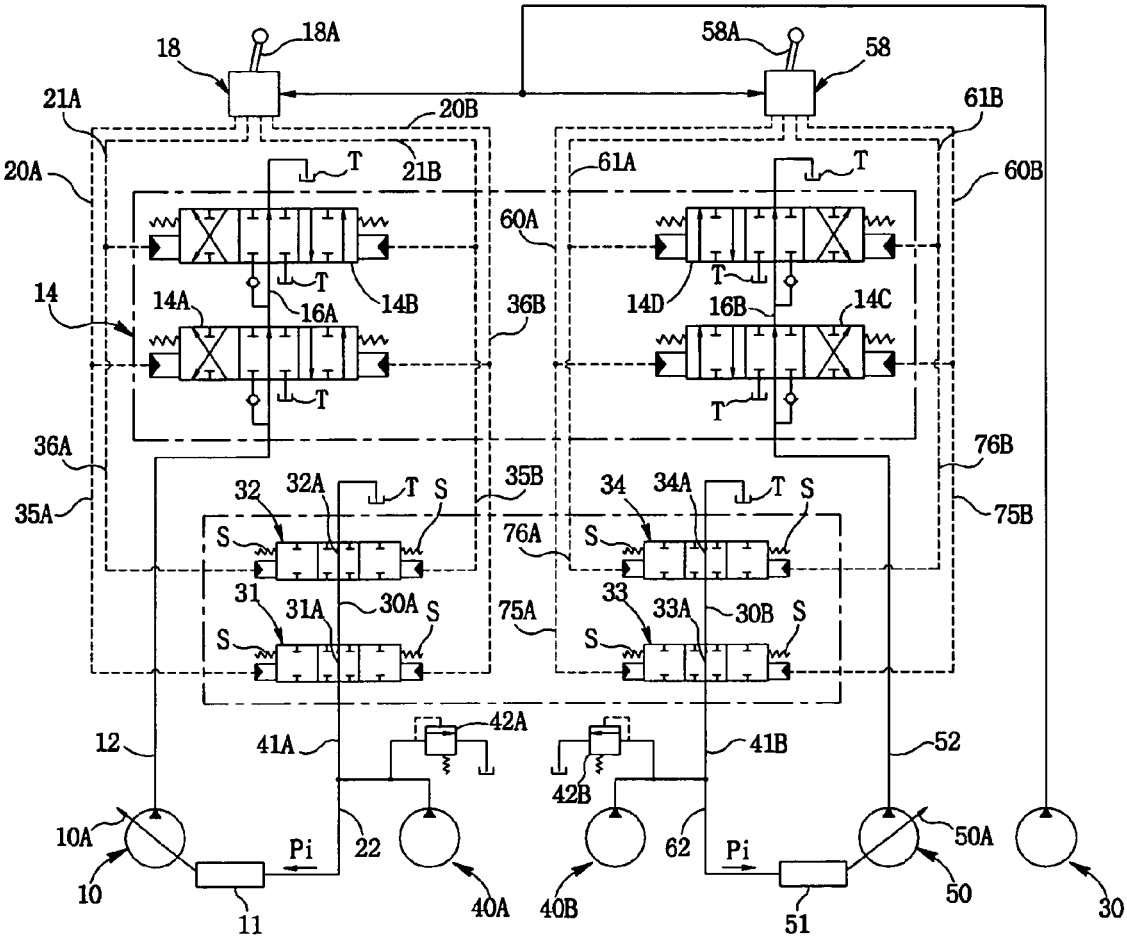
FIG. 5 is a schematic fluid pressure circuit diagram showing a fluid pump control system for excavators according to another embodiment of the present invention.

Turning to FIG. 5, there is shown a fluid pump control system for excavators according to another embodiment of the present invention. The following description will be focused on the parts or components that differ from those of the preceding embodiment.

The fluid pump control system of the second embodiment includes a couple of auxiliary pumps 40A, 40B that feed a quantity control signal pressure Pi to the fluid quantity control mechanisms 11, 51 of the variable displacement fluid pumps 10, 50.

The auxiliary pumps 40A, 40B are connected to the fluid quantity control mechanisms 11, 51 through the fluid quantity control signal lines 22, 62 so that the quantity control signal pressure Pi can be applied to the fluid quantity control mechanisms 11, 51. The fluid quantity control signal lines 22, 62 are in fluid communication with the fluid tank T via the signal pressure control lines 41A, 41B.

A plurality of cutoff valves 31-34 are connected to the signal pressure control lines 41A, 41B in tandem. The cutoff valves 31-34 are provided with pressure receiving parts and springs S at their opposite sides. The pressure receiving parts of the cutoff valves 31-34 are in fluid communication with the remote control valves 18, 58 through the control lines 35A, 35B, 36A, 36B, 75A, 75B, 76A, 76B and the pilot signal lines 20A, 20B, 21A, 21B, 60A, 60B, 61A, 61B so that the cutoff valves 31-34 and the spools 14A-D of the control valve 14 can be shifted in concert in proportion to the magnitude of the pilot signal pressures created by the remote control valves 18, 58. The springs S return the cutoff valves 31-34 back to neutral positions if no pilot signal pressure is exerted on the pressure receiving parts of the cutoff valves 31-34.

The cutoff valves 31-34 are normally kept in the neutral positions where the hydraulic flow in the signal pressure control lines 41A, 41B is drained to the fluid tank T through bypass flow paths 31A-34A and can be shifted to the left or right into operative positions where the flow path section areas of the signal pressure control lines 41A, 41B are decreased in proportion to the shifting displacement of the cutoff valves 31-34 to build up fluid quantity control signal pressures within the signal pressure control lines 41A, 41B.

Relief valves 42A, 42B are attached to the fluid quantity control signal lines 22, 62 to delimit the fluid quantity control signal pressures within the fluid quantity control signal lines 22, 62 to below a predetermined pressure value.

If the control levers 18A, 58A of the remote control valves 18, 58 are manipulated to simultaneously actuate two hydraulic actuators for composite operations of an excavator, the remote control valves 18, 58 create two pilot signal pressures in proportion to the manipulation amounts of the control levers 18A, 58A. The pilot signal pressures thus created are applied to the pressure receiving parts of the spools 14A-D of the control valve 14 through the pilot signal lines 20A, 20B, 21A, 21B, 60A, 60B, 61A, 61B and also to the pressure receiving parts of the cutoff valves 31-34 through the control lines 35A, 35B, 36A, 36B, 75A, 75B, 76A, 76B. This ensures that the spools 14A-D and the cutoff valves 31-34 are shifted in one direction from their neutral positions in proportion to the pilot signal pressures transmitted to their pressure receiving parts.

In proportion to the shifting amounts thereof, the cutoff valves 31-34 reduce the flow path section areas of the signal pressure control lines 41A, 41B and increase the quantity control signal pressure Pi in the signal pressure control lines 41A, 41B.

On this occasion, the total sum (P1+P2) of the quantity control signal pressures built up by the shifting displacement of the cutoff valves 31-34 is applied to the fluid quantity control mechanisms 11, 51 as a quantity control signal pressure Pi. This enables the fluid pumps 10, 50 to produce hydraulic flows of a quantity great enough to actuate hydraulic actuators for smooth composite operations.

Although certain preferred embodiments of the present invention have been described herein above, it will be apparent to those skilled in the art that various changes or modifications may be made thereto within the scope of the invention defined by the appended claims.

What is claimed is:

1. A fluid pump control system for excavators, comprising:

at least one variable displacement fluid pump and a pilot pump, each pump for producing a hydraulic flow;

fluid quantity control mechanisms for controlling the discharge quantity of the respective fluid pumps;

a control valve having a plurality of spools for controlling the hydraulic flow produced by the displacement fluid pump and supplied to a plurality of hydraulic actuators through main fluid lines;

remote control valves for reducing pressure of the hydraulic flow produced by the pilot pump in proportion to manipulation of control levers and for applying pilot signal pressures to the control valve through pilot signal lines to shift the plurality of spools in one direction;

fluid quantity control signal lines respectively bifurcated from the main fluid lines and connected to the fluid quantity control mechanisms such that the hydraulic flows in the main fluid lines can apply fluid quantity control signal pressures to the fluid quantity control mechanisms;

signal pressure control lines connecting the fluid quantity control signal lines to a fluid tank in order to drop the fluid quantity control signal pressures within the fluid quantity control signal lines; and a plurality of cutoff valves attached to the signal pressure control lines in tandem and shiftable in concert with shifting movement of the plurality of spools of the control valve for increasing the fluid quantity control signal pressures within the signal pressure control lines in proportion to shifting of the plurality of cutoff valves.

2. The system as recited in claim 1, wherein each of the plurality of cutoff valves increases the fluid quantity control signal pressures by reducing flow path section areas of the signal pressure control lines in proportion to a magnitude of the pilot signal pressures of the remote control valves.

3. The system as recited in claim 1, further comprising pressure-reducing valves and orifices attached to the fluid quantity control signal lines.

* * * * *